US009291071B2

(12) United States Patent
Jewess

(10) Patent No.: US 9,291,071 B2
(45) Date of Patent: Mar. 22, 2016

(54) TURBINE NOZZLE BAFFLE

(71) Applicant: United Technologies Corporation, Hartford, CT (US)

(72) Inventor: Gordon F. Jewess, San Diego, CA (US)

(73) Assignee: United Technologies Corporation, Hartford, CT (US)

( * ) Notice: Subject to any disclaimer, the term of this patent is extended or adjusted under 35 U.S.C. 154(b) by 637 days.

(21) Appl. No.: 13/692,171

(22) Filed: Dec. 3, 2012

(65) Prior Publication Data

US 2014/0154059 A1 Jun. 5, 2014

(51) Int. Cl.

| | |
|---|---|
| ***F01D 25/24*** | (2006.01) |
| ***F01D 25/12*** | (2006.01) |
| ***F01D 11/00*** | (2006.01) |

(52) U.S. Cl.

CPC ..... *F01D 25/12* (2013.01); *F01D 11/001* (2013.01); *Y10T 29/49323* (2015.01)

(58) Field of Classification Search

CPC ..... F01D 11/001; F01D 11/003; F01D 11/02; F01D 25/12

USPC ..... 415/173.7

See application file for complete search history.

(56) References Cited

U.S. PATENT DOCUMENTS

| | | | | |
|---|---|---|---|---|
| 3,079,128 | A | | 2/1963 | Burge |
| 4,103,899 | A | | 8/1978 | Turner |
| 4,190,397 | A | | 2/1980 | Schilling et al. |
| 4,655,683 | A | * | 4/1987 | Chaplin ..... 415/137 |
| 4,767,267 | A | | 8/1988 | Salt et al. |
| 5,160,241 | A | | 11/1992 | Glynn |
| 5,482,433 | A | * | 1/1996 | Norris et al. ..... 415/173.7 |
| 5,522,698 | A | | 6/1996 | Butler et al. |
| 6,042,334 | A | | 3/2000 | Schilling |
| 6,109,867 | A | | 8/2000 | Jacques Portefaix |
| 6,471,216 | B1 | | 10/2002 | Brainch et al. |
| 6,558,114 | B1 | | 5/2003 | Tapley et al. |
| 6,892,931 | B2 | | 5/2005 | Steplewski et al. |
| 7,540,709 | B1 | | 6/2009 | Ebert |
| 7,635,251 | B2 | | 12/2009 | Duesler et al. |
| 8,177,495 | B2 | | 5/2012 | Bowes et al. |
| 8,191,374 | B2 | | 6/2012 | Nanataki et al. |
| 2003/0113207 | A1 | | 6/2003 | De Meo |
| 2009/0317244 | A1 | | 12/2009 | Howe et al. |
| 2010/0008760 | A1 | | 1/2010 | Morris et al. |

OTHER PUBLICATIONS

International Searching Authority Patent Cooperation Treaty, International Search Report and Written Opinion, Sep. 4, 2014, 10 pages.

* cited by examiner

*Primary Examiner* — Edward Look
*Assistant Examiner* — Jason Mikus
(74) *Attorney, Agent, or Firm* — Kinney & Lange, P.A.

(57) ABSTRACT

An embodiment of the present invention is a turbine nozzle baffle including an annular box structure. The turbine nozzle baffle includes a first diaphragm, a second diaphragm, and a static portion of a rotating seal that form a one-piece annular box structure. The first diaphragm extends from an inner diameter of the box structure to an outer diameter of the box structure to form a first axial side. The second diaphragm includes a first portion and a second portion. The first portion extends from the inner diameter to the outer diameter to form a second axial side. The second portion extends toward the first axial side to form the outer diameter. The second diaphragm connects to the first diaphragm at the outer diameter. The static portion of the rotating seal faces radially inward at the inner diameter between the first axial side and the second axial side.

23 Claims, 5 Drawing Sheets

TURBINE NOZZLE BAFFLE

BACKGROUND

The present invention relates to baffle for a turbine nozzle. In particular, the invention relates to a turbine nozzle baffle for an axial turbine engine.

A turbine engine ignites compressed air and fuel in a combustion chamber, or combustor, to create a flow of hot combustion gases to drive one or more stages of turbine blades. The turbine blades extract energy from the flow of hot combustion gases to drive an engine shaft. The engine shaft drives a compressor to provide a flow of compressed air. The engine shaft may also supply shaft power for use by a fan to provide thrust in a turbofan engine or for use by, for example, an electrical generator. Nozzles ahead of each of the one or more stages of turbine blades contain vanes to align the flow of hot combustion gases for an efficient attack angle on the turbine blades.

In most instances, a portion of the flow of compressed air flows around turbine rotor disks that connect the turbine blades to the engine shaft. This compressed air flow cools the rotor disks before exiting through gaps between adjacent turbine rotors and nozzles and into the flow of combustion gases. The positive pressure of the exiting compressed air prevents ingestion of hot combustion gases into cavities adjacent to the turbine rotor disks.

The turbine rotor disks spin at very high rates, for example, 60,000 revolutions per minute. In doing so, the turbine rotor disks tend to impart a high degree of angular velocity to the compressed air flowing through the cavities adjacent to the turbine rotor disks. This transfer of energy from the rotating turbine rotor disk to the compressed air represents a drag on the turbine rotor disk, resulting in energy loss and engine inefficiency. This drag is known as windage. Uneven surface features along the cavities adjacent to the turbine rotor disks contribute to windage losses. In addition, a large volume of space adjacent to the turbine rotor disk also increases windage losses.

SUMMARY

An embodiment of the present invention is a turbine nozzle baffle including an annular box structure. The turbine nozzle baffle includes a first diaphragm, a second diaphragm, and a static portion of a rotating seal. The first diaphragm extends from an inner diameter of the box structure to an outer diameter of the box structure to form a first axial side. The second diaphragm includes a first portion and a second portion. The first portion extends from the inner diameter to the outer diameter to form a second axial side. The second axial side is spaced apart from the first axial side in the axial direction. The second portion extends toward the first axial side to form the outer diameter. The second diaphragm connects to the first diaphragm at the outer diameter. The static portion of the rotating seal faces radially inward at the inner diameter between the first axial side and the second axial side. The first diaphragm, the second diaphragm, and the static portion of the rotating seal form a one-piece annular box structure.

DETAILED DESCRIPTION

A baffle adjacent to a turbine rotor disk reduces the volume of space adjacent to the turbine rotor disks and creates an even surface to reduce windage losses. A baffle employed in axial turbine engines between adjacent turbine stages may suffer from a lack of rigidity. This may result in variations in the distances between a baffle and an adjacent turbine rotor disk. Such variations may reduce the effectiveness of cooling air flowing in the cavity between the baffle and the adjacent turbine rotor disk, by decreasing the volume such that the flow of cooling air is restricted. Anticipating this, a design may provide for overcooling, but this results in reduced operating efficiency. In addition, the variations in the cavity between the baffle and the adjacent turbine rotor disk may increase windage losses by increasing the volume of the cavity.

A baffle supports a static portion of a rotating seal. The seal may be designed to permit a fixed amount of cooling flow between cavities on opposite sides of the baffle. Should the static portion shift position relative to a rotating portion, the amount of cooling flow may not be sufficient for one of the cavities. Finally, a baffle may be made up of many pieces which are labor intensive to remove and install for maintenance purposes.

Embodiments of the present invention solve the above-mentioned problems with a turbine nozzle baffle having a one-piece annular box structure. The one-piece annular box structure holds the baffle in a consistent position relative to adjacent rotor disks, thus reducing windage losses and inefficiencies associated with insufficient cooling. In addition, the annular box structure provides a strong, lightweight support for a static portion of a rotating seal. The strong support provided by the annular box structure holds the static portion of the rotating seal rigidly, thus encouraging a consistent position of the static portion relative to a rotating portion of the rotating seal. Finally, the one-piece annular box structure is easily removed and installed for maintenance purposes.

Figure 1:
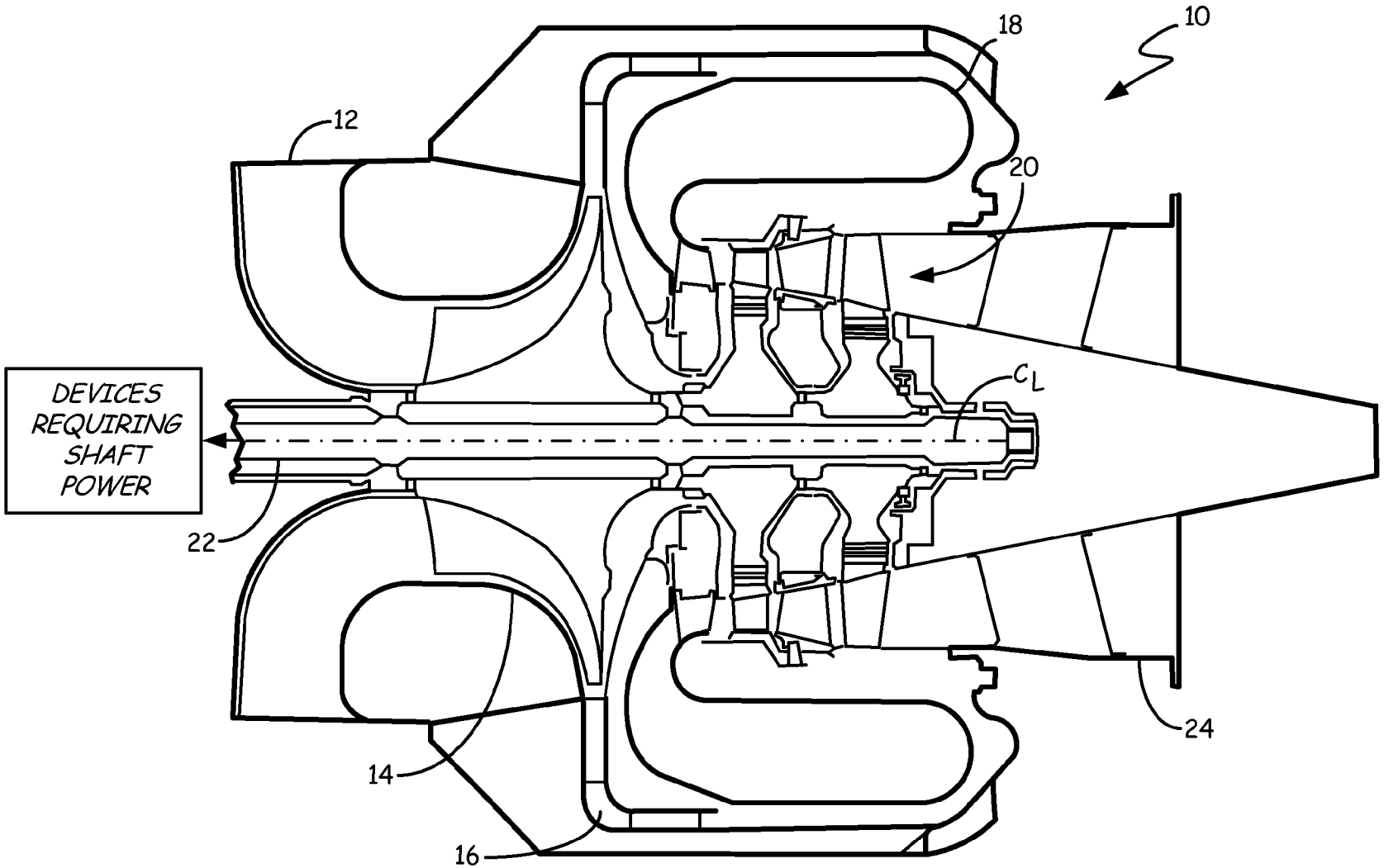
FIG. 1 is a cross-section of an axial turbine engine.

FIG. 1 is a side cross-sectional view of an axial turbine engine embodying the present invention. The view in FIG. 1 is a longitudinal sectional view along an engine axis, center line $C_L$. FIG. 1 shows axial turbine engine 10 including air inlet structure 12, compressor 14, diffuser 16, combustor 18, turbine section 20, shaft 22, and exhaust case 24. Compressor 14 is a single-stage centrifugal flow compressor. Combustor 18 is an annular reverse flow combustor. Turbine section 20 is a two-stage, axial flow turbine. Axial turbine engine 10 may be, for example, an auxiliary power unit. In an embodiment, axial turbine engine 10 is an auxiliary power unit for use aboard an aircraft.

Compressor 14 is positioned between air inlet structure 12 and diffuser 16 such that compressor 14 is in fluid communication with air inlet structure 12 and diffuser 16. Combustor 18 is connected to diffuser 16 and opposite compressor 14. Combustor 18 annularly surrounds turbine section 20. Turbine section 20 is connected to compressor 14 by shaft 22 such that compressor 14 and turbine 20 rotate together around axis $C_L$. Exhaust case 24 is connected to turbine section 20 opposite combustor 18. On the side of compressor 14 opposite turbine section 20, shaft 22 is connected to devices requiring shaft power (not shown). Such devices may be, for example, an electrical generator for supplying aircraft electrical power, or another compressor for supplying compressed air for engine starting or for an environmental control system.

In operation, air enters air inlet structure 12 and flows to compressor 14 where it is accelerated by the centrifugal action of rotating impeller blades. The accelerated air flows to diffuser 16. Diffuser 16 includes a series of impediments to air flow, such as angled vanes, to slow the air, thereby increasing its pressure. A portion of the compressed air then flows into combustor 18 where it mixes with fuel and is ignited, producing a flow of high temperature, high pressure combustion gases. These high temperature, high pressure combustion gases flow to turbine section 20 where they expand rapidly and propel turbines within turbine section 20, as described in greater detail below in reference to FIG. 2. Turbine section 20 drives the rotation of shaft 22 to drive compressor 14 and devices connected to shaft 22 requiring shaft power. Combustion gases flowing out of turbine section 20 flow into exhaust case 24 where they are exhausted from axial turbine engine 10. Some of the compressed air not flowing into combustor 18 flows through turbine section 20 to cool turbine section 20 before joining the flow of combustion gases, as described in greater detail below in reference to FIGS. 2 and 3.

Figure 2:
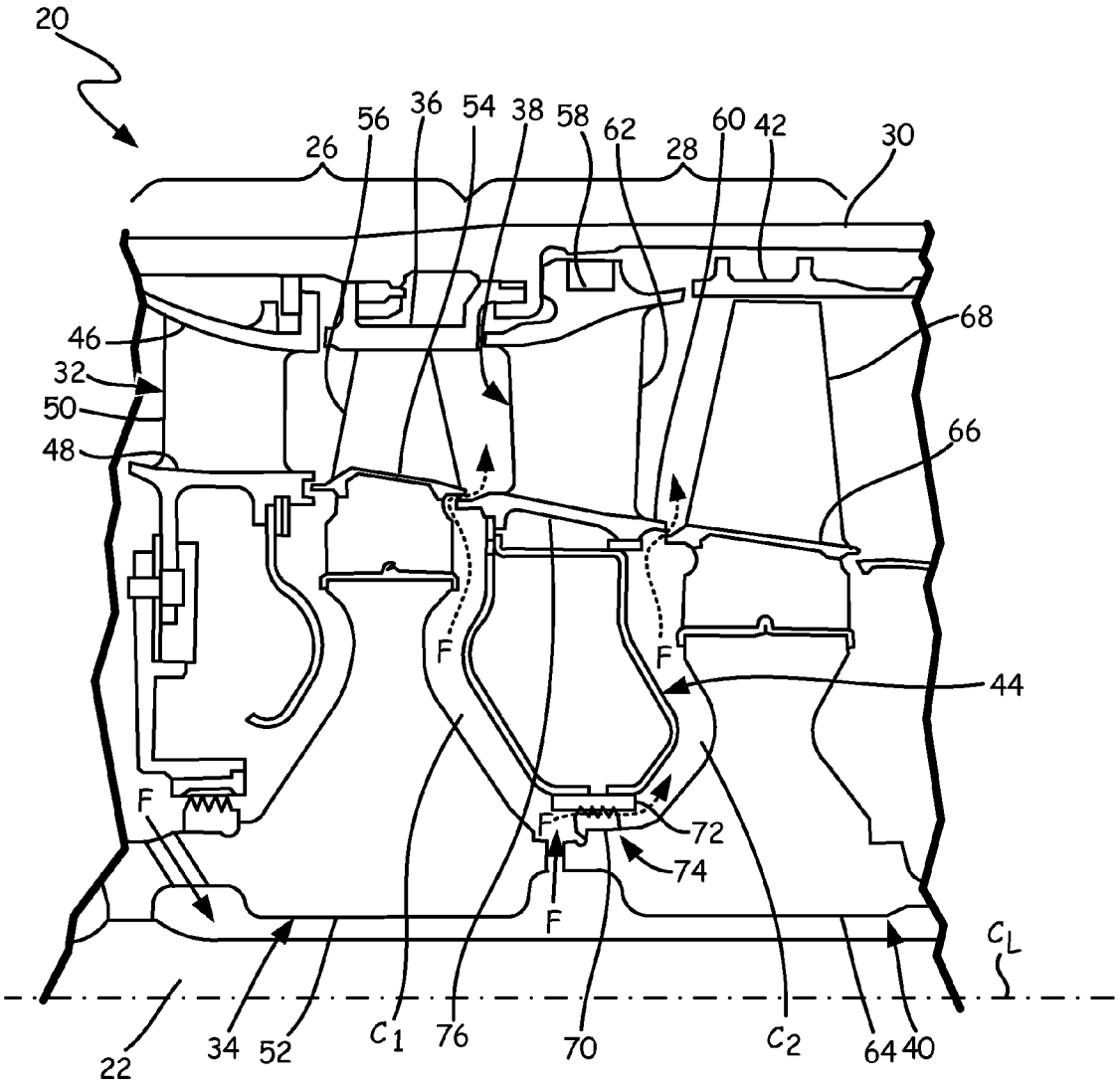
FIG. 2 is a cross-section of a turbine section of the axial turbine engine of FIG. 1 illustrating a one-piece turbine nozzle baffle embodying the present invention.

FIG. 2 is an enlarged sectional view of turbine section 20 of axial turbine engine 10 of FIG. 1 illustrating a one-piece turbine nozzle baffle embodying the present invention. Turbine section 20 is generally symmetrical about engine center line $C_L$, thus only half of turbine section 20 is illustrated. As shown in FIG. 2, turbine section 20 includes first stage 26, second stage 28, and turbine case 30. First stage 26 includes first stage nozzle 32, first stage turbine 34, and first blade outer air seal 36. Second stage 28 includes second stage nozzle 38, second stage turbine 40, second blade outer air seal 42, and baffle 44. First stage nozzle 32 is a ring-shaped structure including first outer shroud 46, first inner shroud 48, and a plurality of first stage vanes 50 extending between first outer shroud 46 and first inner shroud 48. First stage turbine 34 includes first rotor disk 52, first rotor platform 54, and a plurality of first rotor blades 56 projecting radially outward from first rotor platform 54. Second stage nozzle 38 is a ring shaped structure including second outer shroud 58, second inner shroud 60, and a plurality of second stage vanes 62 extending between second outer shroud 58 and second inner shroud 60. Second stage turbine 40 includes second rotor disk 64, second rotor platform 66, and a plurality of second rotor blades 68 projecting radially outward from second rotor platform 66. Second rotor disk 64 includes rotor seal 70. Rotor seal 70 is a rotating portion of a rotating seal 74, for example, a rotating portion of a labyrinth seal having a series of teeth. Rotor seal 70 is connected to second rotor disk 64 near first rotor disk 52 and faces radially outward. Second blade outer air seal 42 circumferentially surrounds second stage turbine 40. Baffle 44 includes seal land 72. Seal land 72 is a static portion of rotating seal 74, for example, a static portion of a labyrinth seal having a series of grooves.

First stage turbine 34 and second stage turbine 40 are connected to each other and to shaft 22, such that they rotate together. First stage nozzle 32 is a static component connected to turbine case 30 on a side of first stage turbine 34 opposite second stage turbine 40. Second stage nozzle 38 is connected to turbine case 30 between first stage turbine 34 and second stage turbine 40. First blade outer air seal 36 is a static component connected to turbine case 30 and circumferentially surrounding first stage turbine 34. Second blade outer air seal 42 is also a static component connected to turbine case 30, but circumferentially surrounding second stage turbine 40. Baffle 44 is connected to second stage nozzle 38 at inner diameter 76 of second inner shroud 60. Inner diameter 76 is a side opposite a side of second shroud 60 from which second stage vanes 62 extend to second outer shroud 58. Rotor seal 70 and seal land 72 engage to form rotating seal 74.

In operation, the flow of combustion gases from combustor 18 (FIG. 1) enters first stage 26 of turbine section 20 at first stage nozzle 32 where first stage vanes 50 align the flow of combustion gases for an efficient attack angle on first rotor blades 56 of first stage turbine 34. The combustion gases expand rapidly as they flow past first rotor blades 56 to propel the rotation of first rotor disk 52. The gases then flow through second stage 28 at second stage nozzle 38, where second stage vanes 62 again align the flow of combustion gases, this time for an efficient attack angle on second rotor blades 68 of second stage turbine 40. The combustion gases again expand rapidly as they flow past second rotor blades 68 to propel the rotation of second rotor disk 64. First rotor disk 52 and second rotor disk 64 rotate connected shaft 22 to provide shaft power. Through turbine section 20, the flow of combustion gases is contained between a radially outer wall defined by first outer shroud 46, first blade outer air seal 36, second outer shroud 58, and second blade outer air seal 42; and a radially inner wall defined by first inner shroud 48, first rotor platform 54, second inner shroud 60, and second rotor platform 66.

As noted above in reference to FIG. 1, some of the compressed air not flowing into combustor 18 flows through turbine section 20 to cool turbine section 20 before joining the flow of combustion gases. As shown in FIG. 2, baffle 44 forms two cavities, first cavity C1 between baffle 44 and adjacent first rotor disk 52; and second cavity C2 between baffle 44 and adjacent second rotor disk 64. A portion of the flow of compressed air F flows into first cavity C1, between baffle 44 and first rotor disk 52 to cool first rotor disk 52. The flow of compressed air F then flows from first cavity C1 into the flow of combustion gases through a gap between first rotor platform 54 and second inner shroud 60 to prevent ingestion of the high temperature combustion gases through the gap. Compressed air F also flows from first cavity C1 through rotating seal 74, and into second cavity C2. Second cavity C2 is between baffle 44 and adjacent second rotor disk 64. The flow of compressed air F flows through second cavity C2 to cool second rotor disk 64 before flowing into the flow of combustion gases through a gap between second inner shroud 60 and second rotor platform 66, again to prevent ingestion of combustion gases through the gap. Rotating seal 74 is designed to permit a fixed flow of compressed air F to pass through to second cavity C2. Control of this flow depends to some extent on a stable relative position between rotor seal 70 and seal land 72. For example, if rotating seal 74 is a labyrinth seal, for fixed pressure conditions, the flow through rotating seal 74 is determined by the gap between the teeth of rotor seal 70 and the grooves of seal land 72. To the extent that the flow of compress air F through rotating seal 74 is inconsistent, pressure in first cavity C1 or second cavity C2 may drop such that cooling for the adjacent rotor disk is insufficient or, the pressure in the cavity is less than the pressure in the flow of combustion gases, resulting in the ingestion of hot combustion gases.

Baffle 44 also reduces windage losses by presenting a smooth surface to adjacent surfaces of first rotor disk 52 and second rotor disk 64. Baffle 44 also determines the volume of first cavity C1 and second cavity C2. Baffle 44 is designed to balance the requirements of minimizing the volume of air subject to drag and ensuring enough volume to support a flow of compressed air F for sufficient cooling. Movement of baffle 44 relative to first rotor disk 52 or second rotor disk 64 may throw off this balance, resulting in insufficient cooling and increased windage losses.

Figure 3:
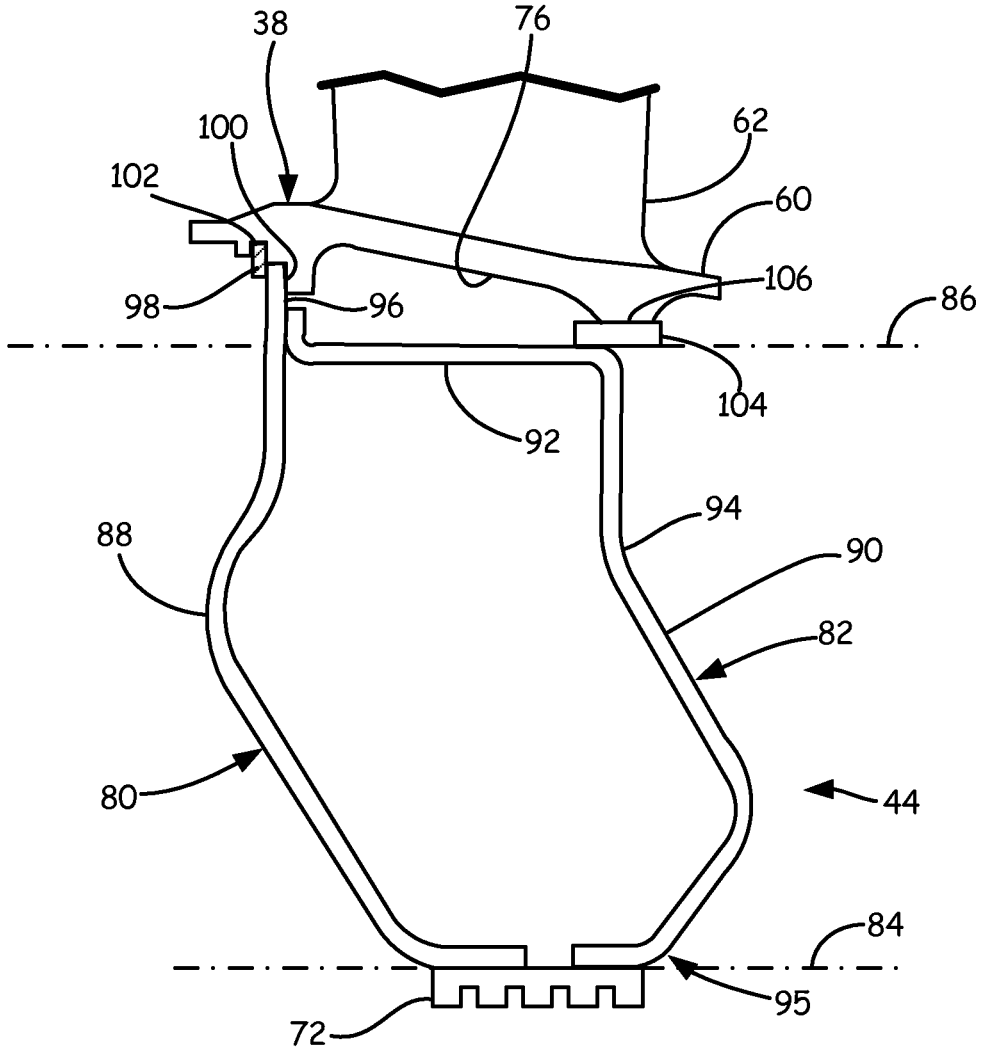
FIG. 3 is an enlarged cross-section of the turbine section of FIG. 2 showing additional features of the one-piece turbine nozzle baffle of FIG. 2.

FIG. 3 is an enlarged cross-section of the turbine section of FIG. 2 showing additional features of baffle 44. As shown in detail in FIG. 3, baffle 44 includes one-piece annular box structure 95 that provides a strong, lightweight support. Baffle 44 further includes first diaphragm 80, and second diaphragm 82. First diaphragm 80 extends from inner diameter 84 to outer diameter 86 to form first axial side 88. Second diaphragm 82 includes first portion 90 and second portion 92. First portion 90 extends from inner diameter 84 to outer diameter 86 to form second axial side 94. Second portion 92 extends axially from second axial side 94 to first axial side 88 to form outer diameter 86. Thus, second axial side 94 is spaced apart from first axial side 88 and second diaphragm 82 connects to first diaphragm 80 at outer diameter 86. Seal land 72 faces radially inward and connects to first diaphragm 80 and to second diaphragm 82 at inner diameter 84. The connections between first diaphragm 80, second diaphragm 82, and seal land 72 are, for example, brazed connections, welded connections, rivets, or spot welds. Thus, together, first diaphragm 80, second diaphragm 82, and seal land 72 form one-piece annular box structure 95 of baffle 44.

One-piece annular box structure 95 of baffle 44 provides a strong, lightweight support for seal land 72. The strong support provided by annular box structure 95 holds seal land 72 rigidly, thus encouraging a consistent position of seal land 72 relative to rotor seal 70, and resulting in more consistent performance from rotating seal 74. In addition, annular box structure 95 holds first diaphragm 80 and second diaphragm 82 in consistent positions relative to first rotor disk 52 and second rotor disk 64, thus reducing windage losses.

Considering FIGS. 2 and 3 together, first rotor disk 52 is contoured to provide a combination of strength and weight distribution suitable for a turbine rotor disk. First axial side 88 of first diaphragm 80 is contoured to match the contour of first rotor disk 52 such that first cavity C1 is shaped to balance the requirements of minimizing the volume of air subject to drag and ensuring enough volume to support the flow of compressed air F for sufficient cooling. Second rotor disk 64 is also contoured, but because it is a different size than first rotor disk 64, its contour is different. Second axial side 94 of second diaphragm 82 is correspondingly contoured to match the contour of second rotor disk 64 to provide a suitable volume for second cavity C2.

Also as shown in FIG. 3, first diaphragm 80 may include annular flange 96. Annular flange 96 projects radially outward beyond outer diameter 86. Annular flange 96 may be employed to connect baffle 44 to second stage nozzle 38 at inner diameter 76. Such a connection is not permanent, enabling convenient removal and installation of baffle 44 for maintenance purposes. In such a case, axial turbine engine 10 may further include retaining ring 98. In an embodiment, retaining ring 98 is a flat, open ring having a spring force sufficient to hold itself within a retaining ring slot, as is known in the art. Inner diameter 76 may include flange recess 100 and retaining ring slot 102. Flange recess 100 extends circumferentially around second stage nozzle 38 at inner diameter 76. Retaining ring slot 102 is adjacent to flange recess 100, also extending circumferentially around second stage nozzle 38 at inner diameter 76. Retaining ring slot 102 opens radially inward and is sized to accept retaining ring 98. When installed, annular flange 96 is disposed within flange recess 100 and retaining ring 98 is disposed within retaining ring slot 102 such that annular flange 96 is retained within flange recess 100. By retaining annular flange 96, which is an integral part of first diaphragm 80, baffle 44 connects to inner diameter 76 of second stage nozzle 38.

FIG. 3 illustrates that baffle 44 may also include interference fit ring 104. Interference fit ring 104 is connected to second portion 92 at outer diameter 86 near second axial side 94 by, for example, brazing or welding to second diaphragm 82. Interference fit ring 104 is machined such that outer diameter 106 of interference fit ring 104 is greater than a portion of inner diameter 76 when baffle 44 and second stage nozzle 38 are at the same temperature, and outer diameter 106 of interference fit ring 104 is less than the portion of inner diameter 76 when baffle 44 is at a lower temperature than second stage nozzle 38. The interference fit formed in this way connects baffle 44 to inner diameter 76 of second stage nozzle 38. As with the connection described above employing annular flange 96, the interference fit connection is not permanent, enabling convenient removal and installation of baffle 44 for maintenance purposes.

Installation of baffle 44 into second stage nozzle 38 may begin with altering the temperature of at least one of one of baffle 44 and second stage nozzle 38 such that outer diameter 106 of interference fit ring 104 at outer diameter 86 fits within inner diameter 76 of the second stage nozzle 38, within which it would not fit without altering the temperature. For example, baffle 44 may be cooled, or second stage nozzle 38 may be heated, or both. Next, baffle 44 is inserted into inner diameter 76 until annular flange 96 contacts flange recess 100. Annular flange 96 is secured against flange recess 100. Finally, baffle 44 and second stage nozzle 38 are allowed to reach an equilibrium temperature, forming an interference fit.

In the embodiment of FIG. 3, annular flange 96 may be secured against flange recess 100 by compressing retaining ring 98, inserting compressed retaining ring 98 into inner diameter 76 until retaining ring 98 contacts annular flange 96, and releasing compressed retaining ring 98 such that it expands into retaining ring slot 102.

Figure 4:
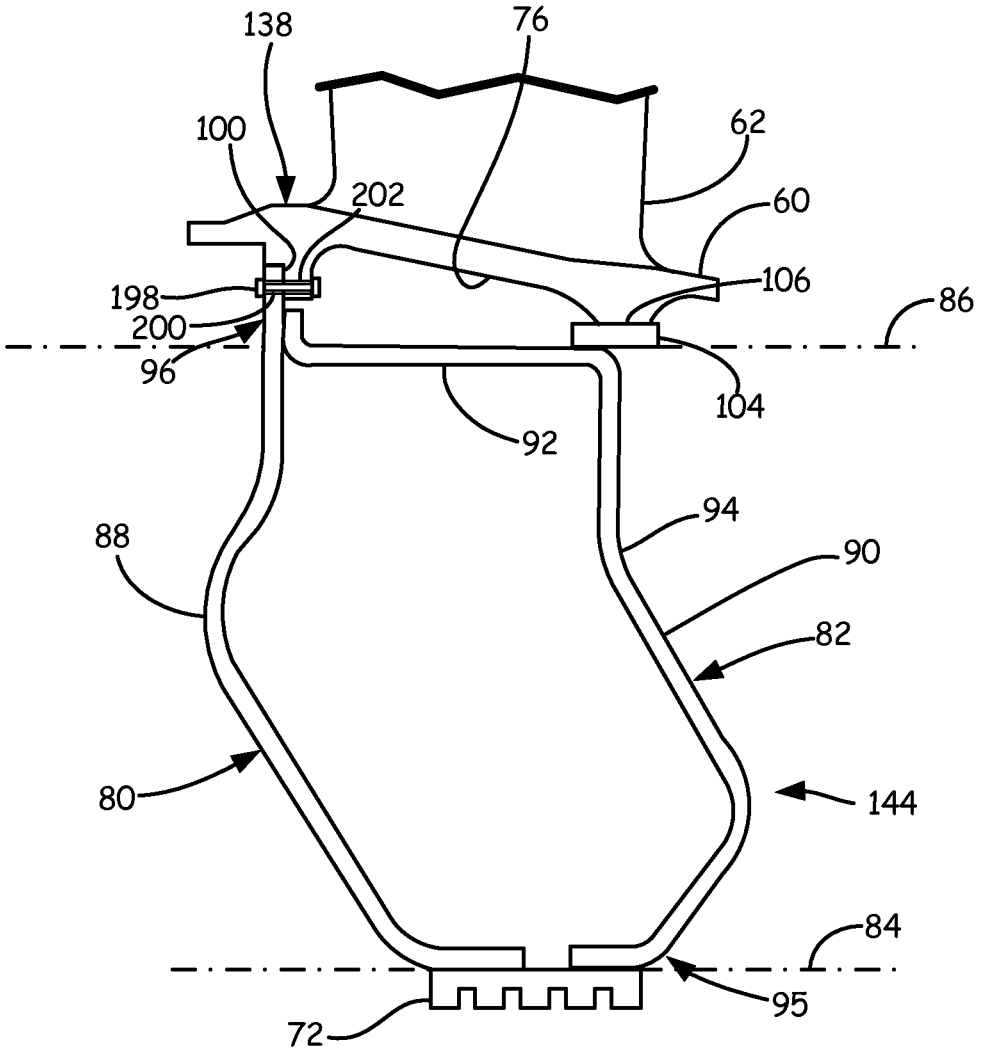
FIG. 4 is an enlarged cross-section of the turbine section of FIG. 2 showing features of another embodiment of the one-piece turbine nozzle baffle.

Alternatively, securing annular flange 96 against flange recess 100 may be done by bolting or riveting, as illustrated in the embodiment of FIG. 4. FIG. 4 is an enlarged cross-section of the turbine section of FIG. 2 illustrating baffle 144 secured to second stage nozzle 138 by a plurality of fasteners 198 (one shown). Baffle 144 is identical to baffle 44 as shown above in reference to FIG. 3, except that annular flange 96 includes a plurality of flange openings 200. Flange openings 200 are axial openings in annular flange 96 spaced circumferentially around baffle 144. Second stage nozzle 138 is identical to second stage nozzle 38, except that second stage nozzle 138 includes a plurality of recess openings 202 at flange recess 100, and retaining ring slot 102 is omitted. Recess openings 202 are axial openings in flange recess 100 spaced circumferentially around second stage nozzle 138. Flange openings 200 and recess openings 202 may be aligned such that fasteners 198 may be installed within flange openings 200 and recess openings 202 to secure annular flange 96 against flange recess 100. Fasteners 198 may be, for example bolts or rivets.

First diaphragm 80 and second diaphragm 82 are annular structures and may be formed from sheet metal, for low cost and ease of manufacture. In contrast, interference fit ring 104 may be made of a cast metal and outer diameter 106 machined to achieved the dimensional tolerances necessary for an interference fit with second stage nozzle 38. In both cases, the metal may be, for example, a nickel-based alloy.

Figure 5:
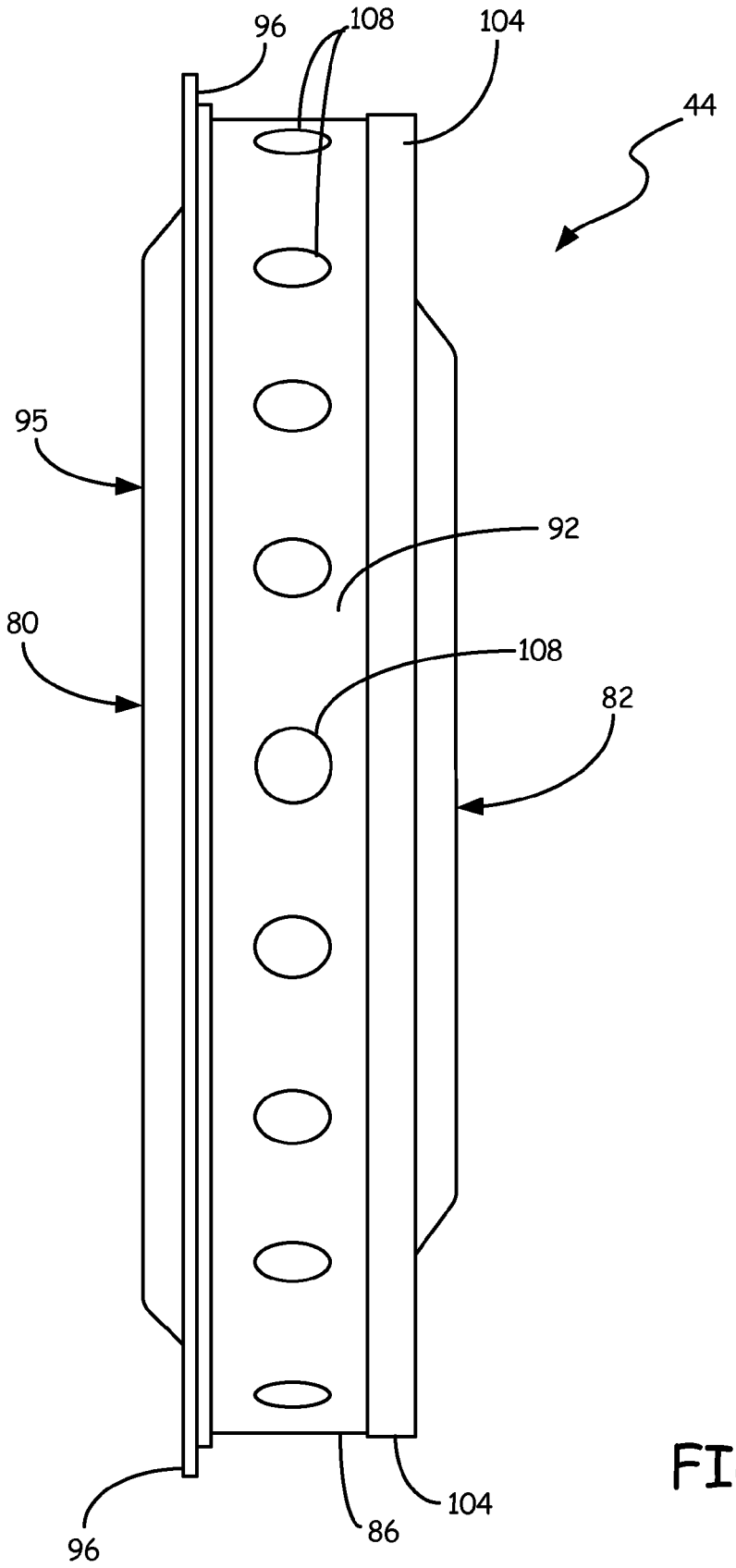
FIG. 5 is a radial side view of the one-piece turbine nozzle baffle of FIG. 3.

FIG. 5 is a radial side view of the baffle 44 of FIG. 3. Identically numbered features are the same between the two figures. As shown in FIG. 5, baffle 44 may include a plurality of lightening holes 108 in one-piece annular box structure 95. Considering FIGS. 3 and 5 together, in order to not interrupt the smooth surfaces of first axial side 88 and second axial side 94, or interfere with seal land 72, lightening holes 108 are through second portion 92 at outer diameter 86.

For the sake of brevity, all embodiments above are described for a second stage turbine nozzle baffle. However, it is understood that the present invention encompasses embodiments where the turbine nozzle baffle is employed at other than the second stage, and between adjacent turbine rotor disks.

Embodiments of the present invention include a turbine nozzle baffle having a one-piece annular box structure. The one-piece annular box structure provides a strong, lightweight support for a static portion of a rotating seal. The strong support provided by the annular box structure holds the static portion of the rotating seal rigidly, thus encouraging a consistent position of the static portion relative to a rotating portion of the rotating seal. In addition, the annular box structure holds the baffle in a consistent position relative to adjacent rotor disks, thus reducing windage losses. Finally, the one-piece annular box structure is easily removed and installed for maintenance purposes.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Discussion of Possible Embodiments

The following are non-exclusive descriptions of possible embodiments of the present invention.

A turbine nozzle baffle including an annular box structure includes a first diaphragm extending from an inner diameter of the box structure to an outer diameter of the box structure to form a first axial side; a second diaphragm, a first portion of the second diaphragm extending from the inner diameter to the outer diameter to form a second axial side, the second axial side spaced apart from the first axial side in an axial direction; a second portion of the second diaphragm extending toward the first axial side to form the outer diameter; the second diaphragm connected to the first diaphragm at the outer diameter; and a static portion of a rotating seal facing radially inward at the inner diameter between the first axial side and the second axial side; wherein the first diaphragm, the second diaphragm, and the static portion of the rotating seal form a one-piece annular box structure.

The baffle of the preceding paragraph can optionally include, additionally and/or alternatively, any one or more of the following features, configurations and/or additional components:

the first diaphragm includes a flange projecting radially outward from the outer diameter at the first axial side;

an interference fit ring connected to the outer diameter at the second axial side;

the interference fit ring is a cast ring including a machined outside diameter surface;

the static portion of the rotating seal connects to each of the first diaphragm and the second diaphragm at the inner diameter;

the connections between the first diaphragm, and the second diaphragm; the static portion of the rotating seal, and each of the first diaphragm and the second diaphragm; and the interference fit ring, and the second diaphragm are brazed connections; the first diaphragm and the second diaphragm are formed from sheet metal;

at least one of the sheet metal and the interference fit ring is made of a nickel-based alloy; and a plurality of lightening holes through the box structure at the outer diameter.

An axial gas turbine engine includes a first turbine rotor; a second turbine rotor; a rotor shaft connecting the first turbine rotor to the second turbine rotor, the rotor shaft including a rotating portion of a rotating seal; a turbine nozzle between the first turbine rotor and the second turbine rotor; and a turbine nozzle baffle connected to an inner diameter of the turbine nozzle, the turbine nozzle baffle including a one-piece annular box structure.

The engine of the preceding paragraph can optionally include, additionally and/or alternatively, any one or more of the following features, configurations and/or additional components:

the one-piece annular box structure includes a first diaphragm extending from an inner diameter of the baffle to an outer diameter of the baffle to form a first axial side; a second diaphragm, a first portion of the second diaphragm extending from the inner diameter of the baffle to the outer diameter of the baffle to form a second axial side, the second axial side spaced apart from the first axial side in an axial direction; a second portion of the second diaphragm extending toward the first axial side to form the outer diameter of the baffle; the second diaphragm connected to the first diaphragm at the outer diameter of the baffle; and a static portion of a rotating seal facing radially inward at the inner diameter of the baffle between the first axial side and the second axial side;

the static portion of the rotating seal and the rotating portion of the rotating seal cooperate to form a seal between a first cavity between the first turbine rotor and first axial side, and a second cavity between the second turbine rotor and the second axial side;

the first axial side is contoured to match a contour of the first turbine rotor and the second axial side is contoured to match a contour of the second turbine rotor;

the first diaphragm includes annular flange projecting radially outward from the outer diameter of the baffle at the first axial side;

a retaining ring; wherein the turbine nozzle includes a flange recess extending circumferentially around the inner diameter of the turbine nozzle; and a retaining ring slot extending circumferentially around the inner diameter of the turbine nozzle adjacent to the flange slot; and the flange is disposed within the flange recess, and the retaining ring is disposed within the retaining ring slot to retain the flange within the flange recess to connect the flange to the inner diameter of the turbine nozzle;

an interference fit ring connected to the outer diameter of the baffle at the second axial side; and the static portion of the rotating seal connects to each of the first diaphragm and the second diaphragm at the inner diameter of the baffle.

A method of installing a turbine nozzle baffle in an inner diameter of a turbine nozzle includes altering the temperature of at least one of the turbine nozzle baffle and the turbine nozzle such that an outer diameter of an interference fit ring connected to an outer diameter of the turbine nozzle baffle fits within an inner diameter of the turbine nozzle; inserting the turbine nozzle baffle into the inner diameter of the turbine nozzle until a flange of the turbine nozzle baffle contacts a flange recess in the inner diameter of the turbine nozzle; securing the flange against the flange recess; and allowing the temperature of the turbine nozzle baffle and the turbine nozzle to equilibrate.

The method of the preceding paragraph can optionally include, additionally and/or alternatively, any one or more of the following features, configurations and/or additional components:

securing the flange against the flange recess includes compressing a retaining ring; inserting the compressed retaining ring into the inner diameter of the turbine nozzle until it contacts the flange of the turbine nozzle baffle; and releasing the compressed retaining ring such that it expands into a retaining ring slot in the inside diameter of the turbine nozzle, adjacent to the flange recess; and securing the flange against the flange recess includes aligning flange openings in the flange with recess openings at the flange recess; inserting fasteners into the aligned flange openings and recess openings; and securing the fasteners such that the flange is secured against the flange recess.

The invention claimed is:

1. A turbine nozzle baffle including an annular box structure, the baffle comprising:

a first diaphragm extending from an inner diameter of the annular box structure to an outer diameter of the annular box structure to form a first axial side and including a flange projecting radially outward from the outer diameter of the annular box structure at the first axial side;

a second diaphragm, a first portion of the second diaphragm extending from the inner diameter to the outer diameter to form a second axial side, the second axial side spaced apart from the first axial side in an axial direction; a second portion of the second diaphragm extending toward the first axial side to form the outer diameter of the annular box structure; the second diaphragm connected to the first diaphragm at the outer diameter;

a static portion of a rotating seal facing radially inward at the inner diameter between the first axial side and the second axial side; and an interference fit ring connected to the outer diameter of the annular box structure at the second axial side;

wherein the first diaphragm, the second diaphragm, and the static portion of the rotating seal are connected together to form the annular box structure.

2. The baffle of claim 1, wherein the interference fit ring is a cast ring including a machined outside diameter surface.

3. The baffle of claim 2, wherein the static portion of the rotating seal connects to each of the first diaphragm and the second diaphragm at the inner diameter.

4. The baffle of claim 3, wherein the connections between the first diaphragm, and the second diaphragm; the static portion of the rotating seal, and each of the first diaphragm and the second diaphragm; and the interference fit ring, and the second diaphragm are brazed connections.

5. The baffle of claim 4, wherein the first diaphragm and the second diaphragm are formed from sheet metal.

6. The baffle of claim 5, wherein at least one of the sheet metal and the interference fit ring is made of a nickel-based alloy.

7. The baffle of claim 1, further including a plurality of lightening holes through the box structure at the outer diameter.

8. An axial gas turbine engine comprising:

a first turbine rotor;

a second turbine rotor;

a rotor shaft connecting the first turbine rotor to the second turbine rotor, the rotor shaft including a rotating portion of a rotating seal;

a turbine nozzle between the first turbine rotor and the second turbine rotor;

a turbine nozzle baffle connected to an inner diameter of the turbine nozzle, the turbine nozzle baffle including an annular box structure wherein the turbine nozzle baffle comprises:

a first diaphragm extending from an inner diameter of the annular box structure to an outer diameter of the annular box structure to form a first axial side; and including an annular flange projecting radially outward from the outer diameter of the annular box structure at the first axial side;

a second diaphragm, a first portion of the second diaphragm extending from the inner diameter of the annular box structure to the outer diameter of the annular box structure to form a second axial side, the second axial side spaced apart from the first axial side in an axial direction; a second portion of the second diaphragm extending toward the first axial side to form the outer diameter of the annular box structure; the second diaphragm connected to the first diaphragm at the outer diameter of the annular box structure;

a static portion of a rotating seal facing radially inward at the inner diameter of the annular box structure between the first axial side and the second axial side; and an interference fit ring connected to the outer diameter of the baffle at the second axial side;

wherein the first diaphragm, the second diaphragm, and the static portion of the rotating seal are connected together to form the annular box structure.

9. The engine of claim 8 wherein the static portion of the rotating seal and the rotating portion of the rotating seal cooperate to form a seal between a first cavity between the first turbine rotor and first axial side, and a second cavity between the second turbine rotor and the second axial side.

10. The engine of claim 8, wherein the first axial side is contoured to match a contour of the first turbine rotor and the second axial side is contoured to match a contour of the second turbine rotor.

11. The engine of claim 8, further including a retaining ring; wherein:

the turbine nozzle includes:

a flange recess extending circumferentially around the inner diameter of the turbine nozzle; and a retaining ring slot extending circumferentially around the inner diameter of the turbine nozzle adjacent to the flange slot; and the flange is disposed within the flange recess, and the retaining ring is disposed within the retaining ring slot to retain the flange within the flange recess to connect the flange to the inner diameter of the turbine nozzle.

12. The engine of claim 8 , wherein the static portion of the rotating seal connects to each of the first diaphragm and the second diaphragm at the inner diameter of the baffle.

13. A method of installing a turbine nozzle baffle in an inner diameter of a turbine nozzle comprises:

altering the temperature of at least one of the turbine nozzle baffle and the turbine nozzle such that an outer diameter of an interference fit ring connected to an outer diameter of the turbine nozzle baffle fits within an inner diameter of the turbine nozzle;

inserting the turbine nozzle baffle into the inner diameter of the turbine nozzle until a flange of the turbine nozzle baffle contacts a flange recess in the inner diameter of the turbine nozzle;

securing the flange against the flange recess; and allowing the temperature of the turbine nozzle baffle and the turbine nozzle to equilibrate.

14. The method of claim 13, wherein securing the flange against the flange recess includes:

compressing a retaining ring;

inserting the compressed retaining ring into the inner diameter of the turbine nozzle until it contacts the flange of the turbine nozzle baffle; and releasing the compressed retaining ring such that it expands into a retaining ring slot in the inside diameter of the turbine nozzle, adjacent to the flange recess.

15. The method of claim 13, wherein securing the flange against the flange recess includes:

aligning flange openings in the flange with recess openings at the flange recess;

inserting fasteners into the aligned flange openings and recess openings; and securing the fasteners such that the flange is secured against the flange recess.

16. A turbine nozzle baffle, including an annular box structure, the baffle comprising:

a first diaphragm extending from an inner diameter of the annular box structure to an outer diameter of the annular box structure to form a first axial side;

a second diaphragm, a first portion of the second diaphragm extending from the inner diameter of the annular box structure to the outer diameter of the annular box structure to form a second axial side, the second axial side spaced apart from the first axial side in an axial direction; a second portion of the second diaphragm extending toward the first axial side to form the outer diameter of the annular box structure; the second diaphragm connected to the first diaphragm at the outer diameter of the annular box structure; and a static portion of a rotating seal facing radially inward at the inner diameter of the annular box structure between the first axial side and the second axial side;

wherein the first diaphragm, the second diaphragm, and the static portion of the rotating seal are connected to form the annular box structure, and wherein the annular box structure includes a plurality of lightening holes through the outer diameter.

17. The baffle of claim 16, wherein the first diaphragm includes a flange projecting radially outward from the outer diameter at the first axial side.

18. The baffle of claim 17, further including an interference fit ring connected to the outer diameter at the second axial side, wherein the interference fit ring is a cast ring including a machined outside diameter surface.

19. The baffle of claim 18, wherein the static portion of the rotating seal connects to each of the first diaphragm and the second diaphragm at the inner diameter.

20. The baffle of claim 19, wherein the connections between the first diaphragm, and the second diaphragm; the static portion of the rotating seal, and each of the first diaphragm and the second diaphragm; and the interference fit ring, and the second diaphragm are brazed connections.

21. The baffle of claim 20, wherein the first diaphragm and the second diaphragm are formed from sheet metal.

22. The baffle of claim 21, wherein at least one of the sheet metal and the interference fit ring is made of a nickel based alloy.

23. An axial gas turbine engine comprising: a first turbine rotor; a second turbine rotor; a rotor shaft connecting the first turbine rotor to the second turbine rotor; a turbine nozzle between the first turbine rotor and the second turbine rotor wherein the turbine nozzle includes an outer shroud, an inner shroud, and vanes extending between the inner shroud and the outer shroud, wherein the inner shroud of the turbine nozzle, the first turbine rotor, and the second turbine rotor define a cavity located radially inward from the inner shroud and between the first turbine rotor and the second turbine rotor; and a turbine nozzle baffle connected to an inner wall of the inner shroud and located in the cavity between the first and second turbine rotors, wherein the turbine nozzle baffle includes an annular box structure having a first axial side contoured to match a contour of the first turbine rotor and having a second axial side contoured to match a contour of the second turbine rotor, wherein the annular box structure includes a plurality of lightening holes through an outer diameter of the annular box structure.

* * * * *